US007726146B2

(12) United States Patent
Yeagy et al.

(10) Patent No.: US 7,726,146 B2
(45) Date of Patent: Jun. 1, 2010

(54) BAR WITH MULTIPLE INTEGRAL BEVERAGE THERMAL PLATES

(75) Inventors: Carol Yeagy, Indianapolis, IN (US); Hal Yeagy, Indianapolis, IN (US); John Conover, Indianapolis, IN (US)

(73) Assignee: HCR, Inc., Indianapolis, IN (US)

( * ) Notice: Subject to any disclaimer, the term of this patent is extended or adjusted under 35 U.S.C. 154(b) by 502 days.

(21) Appl. No.: 11/551,452

(22) Filed: Oct. 20, 2006

(65) Prior Publication Data

US 2008/0092578 A1 Apr. 24, 2008

(51) Int. Cl.
*F25D 23/12* (2006.01)
*F25D 17/02* (2006.01)

(52) U.S. Cl. ..... 62/261; 62/259.1; 62/434

(58) Field of Classification Search ..... 62/261, 62/258, 259.2, 259.4, 458, 434; 165/170, 165/48.1, 918–919
See application file for complete search history.

(56) References Cited

U.S. PATENT DOCUMENTS

| | | | | |
|---|---|---|---|---|
| 3,832,862 | A * | 9/1974 | Ingels | 62/227 |
| 4,756,164 | A | 7/1988 | James et al. | |
| 4,762,327 | A * | 8/1988 | Gomez | 273/309 |
| 4,856,579 | A * | 8/1989 | Wolfe | 165/48.1 |
| 4,870,835 | A * | 10/1989 | Wolfe et al. | 62/246 |
| 5,251,790 | A | 10/1993 | Cohn et al. | |
| 5,419,393 | A | 5/1995 | Guy, III | |
| 5,480,015 | A | 1/1996 | Kyees | |
| 5,683,638 | A * | 11/1997 | Crigler et al. | 264/71 |
| 5,921,096 | A * | 7/1999 | Warren | 62/185 |
| 6,725,678 | B2 | 4/2004 | McCann et al. | |
| 6,903,931 | B2 | 6/2005 | McCordic et al. | |
| 2005/0066683 | A1 * | 3/2005 | Schwichtenberg et al. | 62/458 |

FOREIGN PATENT DOCUMENTS

| | | | |
|---|---|---|---|
| DE | 20118899 | * | 2/2002 |
| JP | 08187134 | * | 7/1996 |
| JP | 2002315639 | * | 4/2001 |
| KR | 20010044249 | * | 6/2001 |
| KR | 20060041076 | * | 5/2006 |

* cited by examiner

*Primary Examiner*—Frantz F Jules
*Assistant Examiner*—Cassey Bauer
(74) *Attorney, Agent, or Firm*—Overhauser & Lindman, LLC

(57) ABSTRACT

A refreshment bar includes one embodiment of a cooling or heating apparatus for food and/or beverage containers. The apparatus maintains a food or beverage container placed on one of the plates at a desired cold or hot temperature relative to the bar surface temperature and ambient temperature. The apparatus includes thermally conductive plates, for example stainless steel disks, positioned in recesses such that the upper surfaces of the plates are coplanar with the top surface of the bar, thereby providing a level surface. A thermal exchanger system is used to cool or heat the plates. The system includes a reservoir containing a thermal element and a thermal transfer fluid. The reservoir is located adjacent the lower surface of the bar top. The plates are thermally coupled to the thermal transfer fluid and thermal element, thereby cooling or heating the plates.

18 Claims, 3 Drawing Sheets

BAR WITH MULTIPLE INTEGRAL BEVERAGE THERMAL PLATES

BACKGROUND

The present invention relates to thermal surfaces, and particularly, to cold and hot plates associated with food and beverages.

Restaurants, lounges, coffee bars, and other food and beverage service locations often utilize warmers and coolers to maintain food and beverages at a desired temperature until served to patrons. However, such temperature control equipment is generally not suitable or available for patrons' use while consuming food and beverages. One configuration that is available for cooling beverages at a bar is an ice bar. An ice bar includes a sheet of ice covering substantially the entire upper surface of the bar. Another configuration that is available for heating beverages is an electric hot pad designed to rest on the upper support surface of a furniture top. Such hot pads provide a heated surface that is elevated above the upper support surface and upon which a mug or other beverage container can be placed to keep the beverage hot.

SUMMARY

The present invention may comprise one or more of the following features or combinations thereof. An illustrative embodiment of a beverage bar includes a bar top having an upper surface and a lower surface; a plurality of thermally conductive plates having an upper surface and a lower surface, the plurality of plates coupled with the bar top such that the upper surface of the bar top and the upper surface of the plurality of plates are substantially coplanar; and a means for changing the temperature of the plurality of plates relative to the temperature of the bar top. The means for changing the temperature includes a thermal element and at least one thermally conductive member; and the at least one member is thermally coupled between the thermal element and at least one of the plurality of plates. The means for changing the temperature further includes a reservoir containing a heat transfer fluid; and at least a portion of the thermal element and at least a portion of the at least one member are in thermal contact with the heat transfer fluid. The means for changing the temperature includes a vapor-compression system having an evaporator tube; and the evaporator tube is thermally coupled with the plurality of plates. The means for changing the temperature is adapted to cool the plurality of plates.

The illustrative embodiment of a beverage bar further includes thermal insulation between the bar top and each of the plurality of plates. The bar top includes at least one edge; and the plurality of plates are each positioned approximately equally distant from the at least one edge. The beverage bar further includes a plurality of openings defined in the upper surface of the bar top and wherein each of the plurality of plates is positioned in one of the plurality of openings.

An illustrative embodiment of a thermal surface apparatus includes a furniture top having an upper surface and a lower surface; a first opening defined in the upper surface of the furniture top; a first thermally conductive plate having an upper surface and a lower surface, the first plate positioned in the first opening such that the upper surface of the furniture top and the upper surface of the first plate are substantially coplanar; and a thermal exchanger thermally coupled with the first plate. The thermal surface apparatus further includes a second opening defined in the upper surface of the furniture top; and a second thermally conductive plate having an upper surface and a lower surface, the second plate positioned in the second opening such that the upper surface of the furniture top and the upper surface of the second plate are substantially coplanar; and wherein the thermal exchanger is thermally coupled with the second plate. The thermal surface apparatus further includes a thermally conductive member thermally coupled between the first plate and the thermal exchanger.

The thermal surface apparatus further includes a reservoir containing a heat transfer fluid, the heat transfer fluid thermally coupled with the member and the thermal exchanger. The heat transfer fluid includes propylene glycol. The thermal surface apparatus further includes a temperature sensor adapted to provide a signal relating to a temperature of at least one of the first plate, the member, and the heat transfer fluid; and a controller associated with the thermal exchanger and adapted to receive the signal and to operate the thermal exchanger to control the temperature to a desired temperature. The thermal exchanger further includes a vapor-compression system; and an evaporator tube in contact with at least one of the heat transfer fluid and the member.

The first opening includes a recess and a bore is defined from the recess through to the lower surface of the furniture top. At least a portion of the member is positioned within the bore and the reservoir is positioned adjacent the lower surface of the furniture top. The thermal exchanger is configured to cool the first plate. The thermal exchanger is configured to heat the first plate. The first plate is sized to support a single refreshment container. The furniture top includes an accessible edge; and the horizontal dimensions of the first plate define a depth and a width, the depth being sized to support a single refreshment container, and the width being sized to support multiple refreshment containers. The furniture top includes a surface for at least one of storing, serving, and consuming refreshments.

An illustrative embodiment of a cooling apparatus for beverage containers includes a plurality of thermally conductive plates each adapted to support a beverage container; a plurality of thermally conductive members each thermally coupled with one of the plurality of plates; a cooling element; and a reservoir containing a heat transfer fluid, the heat transfer fluid thermally coupled with the plurality of members and the cooling element. The cooling apparatus for beverage containers further includes a support member having an upper surface and a lower surface; and the plurality of plates each have an upper surface; and the upper surfaces of the plurality of plates are coplanar with the upper surface of the support surface. The support member includes a bar top; and the reservoir is positioned beneath the lower surface of the support member. The cooling apparatus for beverage containers further includes thermal insulation between the support member and the plurality of plates.

These and additional features of the disclosure will become apparent to those skilled in the art upon consideration of the following detailed description of the illustrative embodiments.

DESCRIPTION OF THE ILLUSTRATIVE EMBODIMENTS

Figure 1:
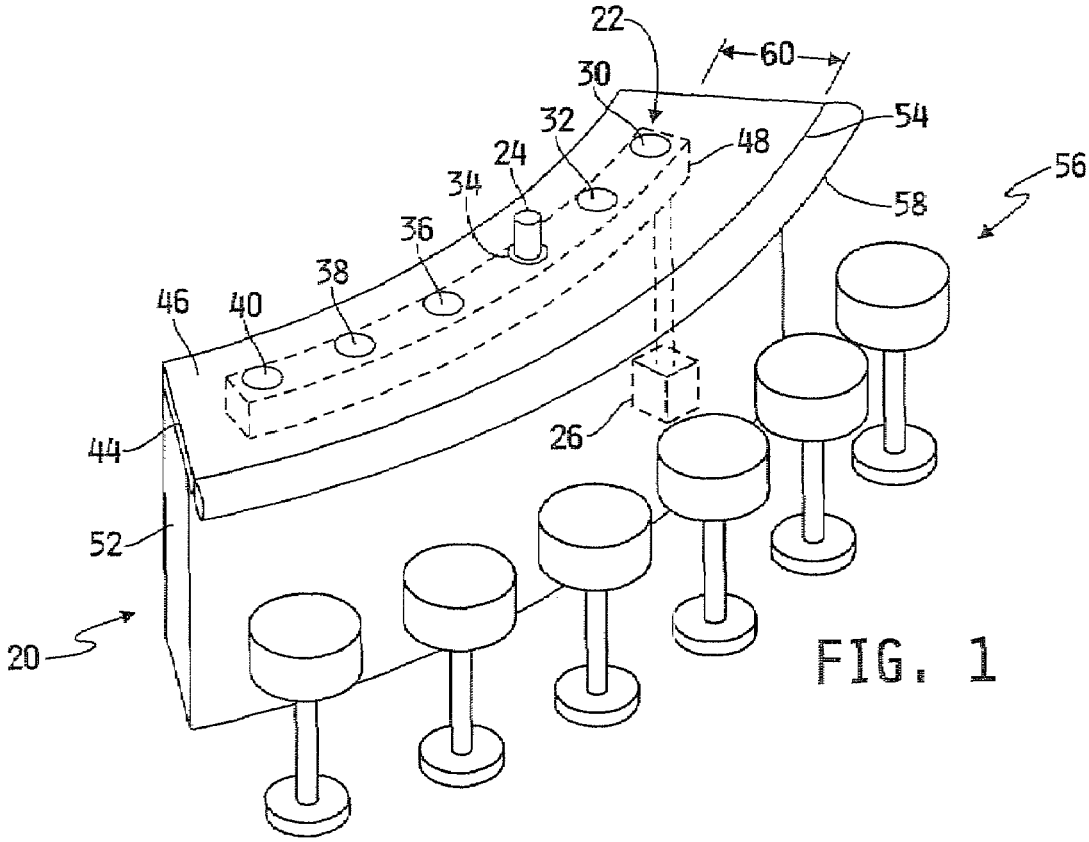
FIG. 1 illustrates a perspective view of a first embodiment of a bar having integral thermally conductive plates located in the upper surface of the bar top and a cooling or heating system located below the lower surface up the bar top.

For the purposes of promoting and understanding the principles of the invention, reference will now be made to one or more illustrative embodiments illustrated in the drawings and specific language will be used to describe the same. It will nevertheless be understood that no limitation of the scope of the invention is thereby intended.

Referring to FIG. 1, a refreshment bar 20, typical of those found in a lounge or restaurant, includes one illustrative embodiment of a cooling or heating apparatus 22 for maintaining food and/or beverage containers 24 at a desired temperature. Refreshments are defined herein to be any food or beverage intended for consumption. The illustrative bar 20 is long enough to accommodate multiple patrons. The apparatus 22 associated with the bar 20 includes thermally conductive plates 30-40 for each bar patron, for example stainless steel disks, positioned in recesses (not shown) such that the upper surface 42 (FIG. 2) of the plates 30-40 are coplanar with the upper surface 46 of the bar top 44. A beverage or other refreshment container 24 placed on one of the plates 30-40 is maintained by the apparatus 22 at a desired cold or hot temperature relative to the surface temperature of a bar top 44 and to the ambient temperature. A thermal exchanger system 26, for example a vapor-compression system, is used to cool or heat the plates 30-40. The thermal exchanger 26 may include a thermal reservoir 48 to which the plates 30-40 are thermally coupled. The thermal exchanger 26 can be located adjacent or below a lower surface 50 of the bar top 44. The configuration of the bar 20 and the apparatus 22 provides an aesthetically pleasing, easily cleanable, and highly functional means for cooling or heating food and beverage containers.

Referring still to FIG. 1, the refreshment bar 20 is generally configured according to typical bars used for serving food and/or beverages. For example, the bar top 44 is supported by an upright pedestal 52 and includes an accessible edge 54 alongside a seating area 56. The accessible edge 54 may include a padded armrest 58 and may overhang the pedestal 52 for added legroom. Advantageously, the components of the apparatus 22 other than the thermal plates 30-40 can be contained within or otherwise concealed from the patrons by the pedestal 52. For example, the thermal exchanger system 26 illustrated in FIG. 1, including the reservoir 48, is located beneath the bar top 44 and within the pedestal 52.

Figure 2:
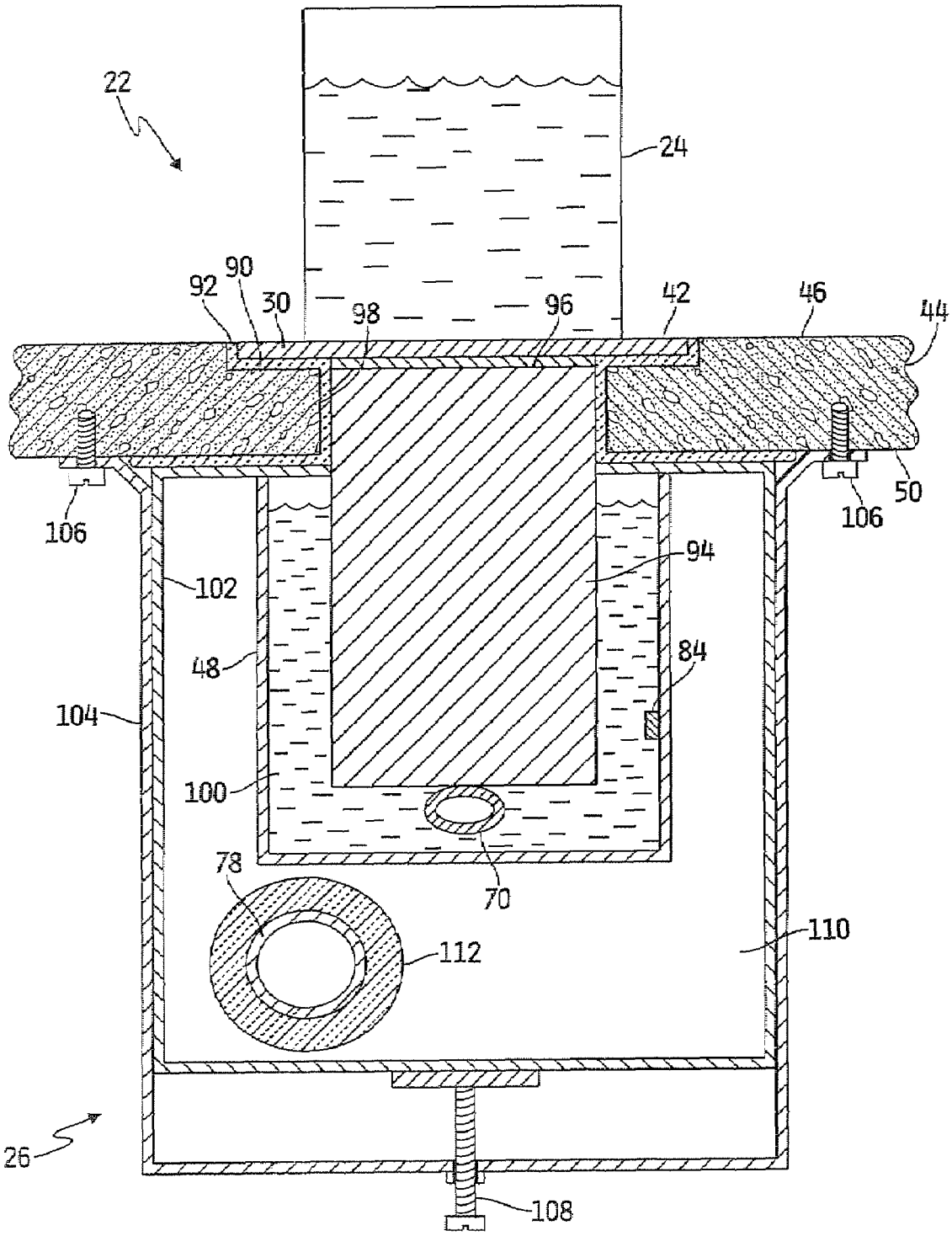
FIG. 2 illustrates a cross-sectional view of the bar in FIG. 1, including a thermally conductive plate, thermally conductive member, and cooling or heating system reservoir.

Although the illustrative embodiment of the cooling or heating apparatus 22 shown in FIG. 1 is associated with a refreshment bar 20, the bar top 44 with which the thermal plates 30-40 are associated may be any support surface associated with furniture top surfaces or support members used in storing, preparing, or serving refreshments. For example, the upper surface 46 with which the upper surface 42 of the thermal plates 30-40 are coplanar, as shown in FIG. 2, may be a table surface supported by legs or by a wall, a surface of a server station, a shelf or other surface for storing beverage bottles, a gaming table, a sideboard, a counter, a desk, a tray, a buffet surface, or any other typically horizontal surface for storing, serving, or consuming refreshments.

As shown in FIG. 1, an illustrative embodiment of the apparatus 22 includes a single thermal plate 30-40 for each refreshment bar patron. The plates 30-40 are located an equal distance 60 from the edge 54 of the bar top 44. For example, the distance 60 can be selected to be a comfortable arm's reach relative to the bar top edge 54, approximately 18 to 20 inches. Alternatively, the apparatus 22 may include more than one thermal plate 30 for each patron or the thermal plates 30-40 may be differently arranged relative to the edge 54 of the bar top 44. For example, the apparatus 22 may include a cold plate sized and positioned for a beverage and a hot plate sized and positioned for a food dish. Additionally, the apparatus 22 and the individual thermal plates 30-40 may be configured to be selectable between a hot setting and a cold setting.

Figure 5:
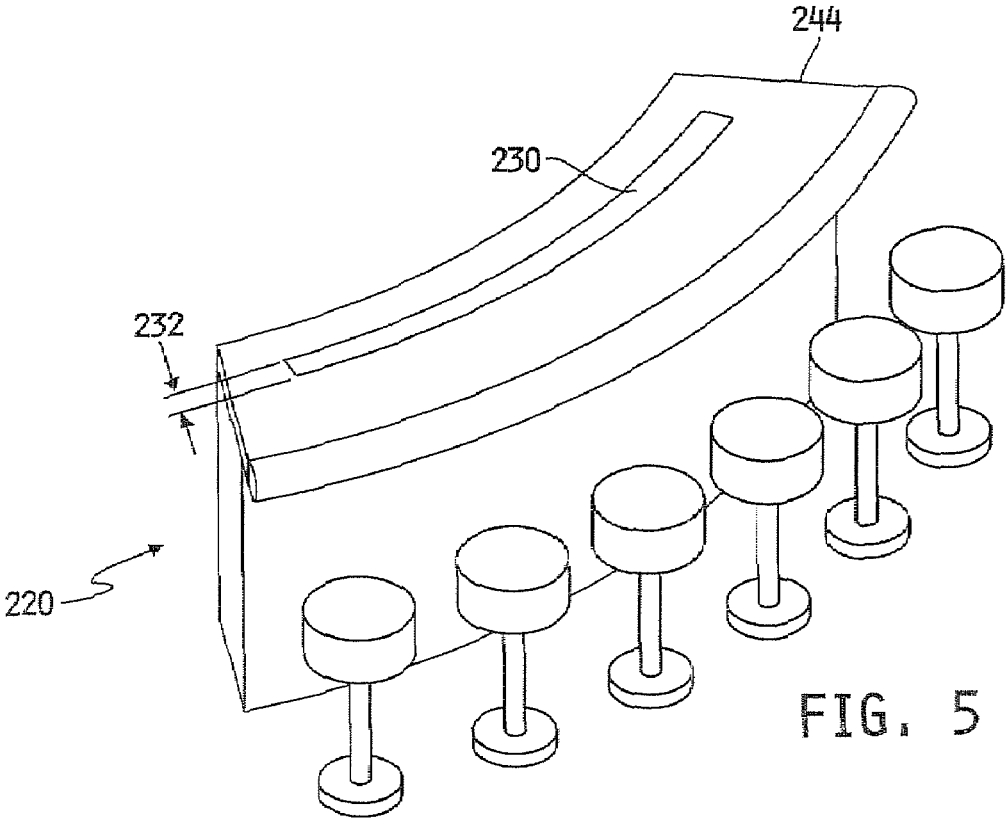
FIG. 5 illustrates a perspective view of a second embodiment of a bar having an integral thermally conductive strip located in the upper surface of the bar top and a cooling or heating system located Below the lower surface of the bar top.

A further alternative embodiment, illustrated in FIG. 5, includes a single thermal plate 230 which extends along the length of a refreshment bar 220. The thermal plate 230 has an upper surface that is coplanar with the upper surface of the bar top 244. The depth 232 of the thermal plate 230 may be sized to accommodate one beverage container or food dish for each patron. The thermal plate 230 may be a generally rectangular and arcuate track, for example in accordance with the shape of the bar top 244. Alternatively, the illustrative refreshment bar 220 may include more than one elongated thermal plate 230, for example, one for cold beverages and one for hot foods or beverages, or several thermal plates 230 for individual cold beverage glasses and one or more thermal plates 230 sized and positioned for cold beverage pitchers.

Figure 3:
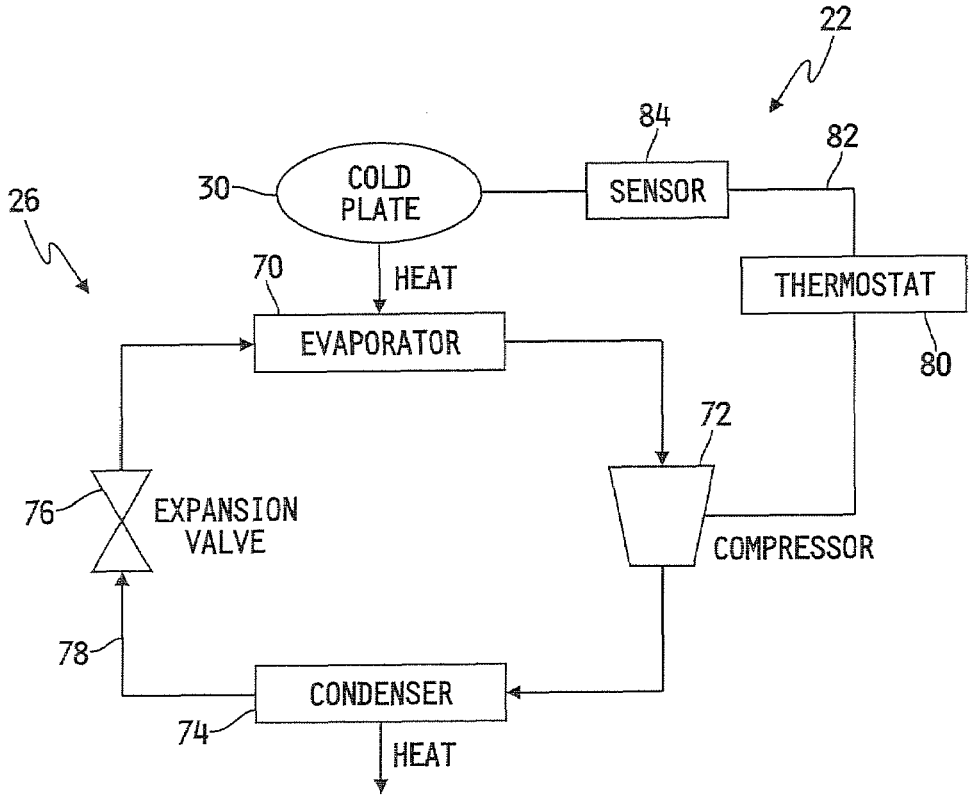
FIG. 3 illustrates a schematic diagram of the thermally conductive plate and cooling system for one embodiment of FIG. 1.

The thermal exchanger system 26 for heating and/or cooling the thermal plates 30-40 may include one or more technologies known in the art, for example, but not limited to, systems utilizing heat plumps, vapor-compression, vapor-absorption, thermoelectrics, magnetics, and cooled or heated fluids. Referring to FIG. 3, one illustrative apparatus 22 for the cooling of thermal plate 30 includes a thermal exchanger system 26 comprising a vapor-compression system. The system 26 includes an evaporator 70, a compressor 72, a condenser 74, an expansion valve 76, and interconnecting conduits 78 for carrying a refrigerant between the various system 26 components.

The evaporator 70 is thermally coupled to the thermal plates 30-40. The system 26 operates in accordance with typical vapor-compression chiller or refrigerator systems; therefore, the expansion of the refrigerant flowing through the evaporator 70 removes heat from the thermal plates 30-40, cooling it. The compressor 72 and the condenser 74, which both generally produce heat, can be thermally isolated from the thermal plates 30-40 and can be located within the pedestal 52 of the bar 20 at either end or at an intermediate position. The compressor 72 can be operated by a controller 80. For example, the controller 80 can be a thermostat that receives a temperature signal 82 from a temperature sensor 84. The temperature sensor 84 may be, for example, a thermal couple associated with the thermal plate 30 or another thermal component of the apparatus 22 as will be described below. The controller 80 can be set to provide a desired temperature for the thermal plate 30. For example, for cooling, the controller 80 can be set so that the thermal plate 30 is at a temperature slightly above the freezing point for water, thereby preventing buildup of ice from any condensation that forms on the thermal plate 30.

Figure 4:
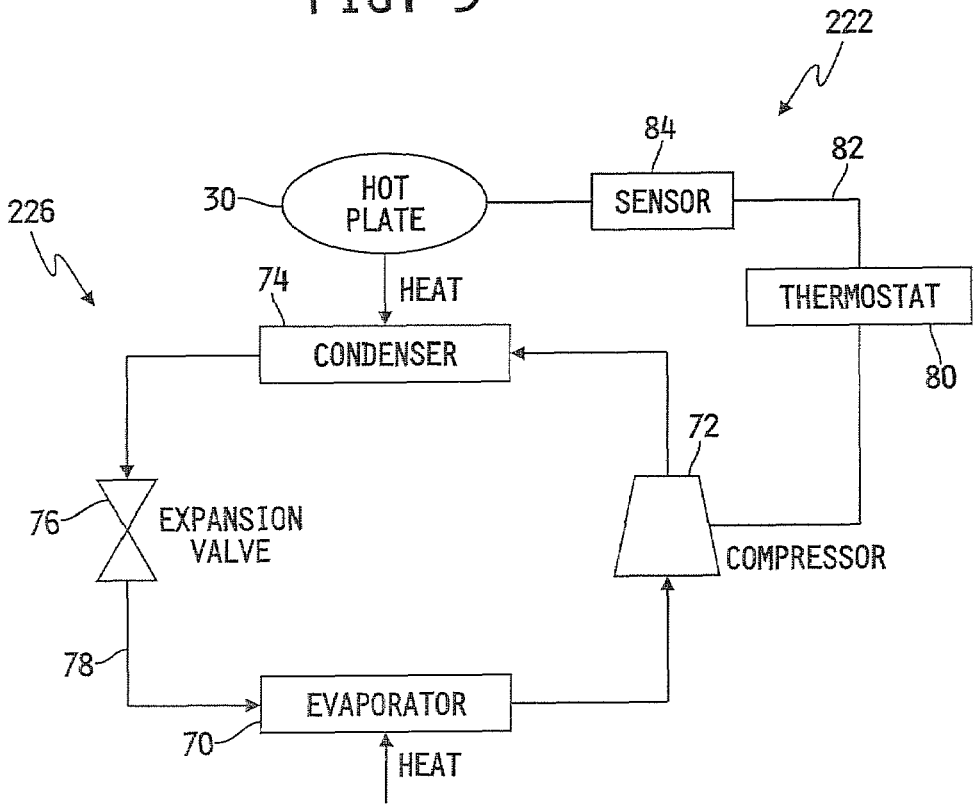
FIG. 4 illustrates a schematic diagram of the thermally conductive plate and heating system for another embodiment of FIG. 1.

Referring to FIG. 4, another illustrative apparatus 222 for heating a thermal plate 30 also includes a thermal exchanger system 226 comprising a vapor-compression system; however, the system 226 is configured with the condenser 70 being in thermal contact with the thermal plates 30-40 in order to transfer heat to the thermal plates 30-40 rather removing heat as in the apparatus 22 shown in FIG. 3. Similar to the apparatus 22 shown in FIG. 3, apparatus 222 shown in FIG. 4 includes a thermal exchanger system 226 that utilizes one or more technologies known in the art, for example, but not limited to, systems utilizing heat pumps, vapor-compression, vapor-absorption, thermoelectrics, magnetics, and cooled or heated fluids.

Referring to FIG. 2, the vertical cross sectional view of a portion of the refreshment bar 20 and the apparatus 22 shown in FIG. 1 further illustrates one embodiment. A recessed opening 90 is defined in the upper surface 46 of the bar top 44. The recessed opening is sized to receive a thermal plate 30 such that the upper surface 42 of the thermal plate 30 is coplanar with the upper surface 46 of the bar top 44. Additionally, depending on the material and thermal conductivity of the bar top 44, the recessed opening 90 may be further sized to accommodate a thermal insulation layer 92 between the thermal plate 30 and the bar top 44. For example, the bar top 44 may be constructed of metal, stone, glass, wood, or another natural, synthetic, or composite material. Some materials that could be utilized are sufficiently thermally conductive that the material would heat or cool in an undesirable fashion if in contact with the thermal plate 30. The thermal insulation layer 92 thermally isolates the bar top 44 from the thermal plates 30 to substantially reduce such undesirable heating or cooling. The thermal insulation layer 92 may be formed from a spill resistant material that is non-porous to liquids and has low thermal conductivity, for example silicone. Alternatively, the thermal insulation layer 92 may be formed by an air gap between the recessed opening 90 and the thermal plate 30.

Although the thermal plate 30 has been generally described as a circular disk constructed from stainless steel and sized to receive a beverage container 24, the thermal plate 30 may define any geometric or nongeometric shape and can be constructed from other thermally conductive materials, for example other metals or ceramics. Other desirable characteristics of the material used for the thermal plate 30 includes being non-porous, non-oxidizing, and sanitary. An illustrative size of the thermal plate 30 is a diameter of approximately 3 to 4 inches or a surface area of approximately 7 to 15 square inches and a thickness of approximately ⅛ to ⅜ inches; however, smaller or larger thermal plates 30 may be utilized. In the illustrative embodiment, the thermal plates 30-40 are sized and associated with the bar top 44 to permit relatively easy removal of the thermal plates 30-40 for cleaning or replacement.

The thermal plate 30 is thermally coupled with the evaporator 70; however, any thermal element capable of heating or capable of cooling could be used in place of the evaporator 70. The evaporator 70 in the illustrative embodiment runs nearly the full length of the bar 20 in order to be closely thermally coupled with all of the thermal plates 30-40. In the illustrative embodiment, a thermally conductive member 94 provides thermal coupling between the evaporator 70 and the thermal plate 30. Additionally, the member 94 functions as a thermal sink to help maintain a relatively constant temperature for the plate 30. In one illustrative embodiment of the thermally conductive member 94 is a cylinder approximately 2 to 4 inches in diameter and 4 to 10 inches in length.

In the illustrative embodiment, a bore 98 is defined in the bar top 44 approximately coaxially with the recessed opening 90. The bore 98 extends from the recessed opening 90 through to the lower surface 50 of the bar top 44. The bore 98 is sized to allow the thermally conductive member 94 to extend though it, and may also be further sized to allow an air gap or the insulation layer 92 between the member 94 and the bar top 44. The thermally conductive member 94 may be in direct contact with the plate 30, may be soldered, welded, are brazed to the plate 30, may be coupled to the plate 30 by a thermal adhesive 96 or other thermally conductive material, or may be formed integrally with the thermal plate 30. The thermally conductive member 94 may be formed from stainless steel or any other thermally conductive, substantially non-oxidizing material.

The thermally conductive member 94 may be soldered, brazed, welded, or otherwise attached to or in contact with the evaporator 70. In one alternative embodiment, the evaporator or other thermal element is integrally associated with the thermally conductive member. In yet another alternative embodiment, a thermally conductive member 94 is not required and the evaporator 70 or other thermal element is directly thermally coupled with the thermal plate 30. In another alternative embodiment, a single thermally conductive member 94 is thermally coupled with all of the individual plates 30-40.

The system 26 also includes a reservoir 48 containing a heat transfer fluid 100. The heat transfer fluid 100 in the illustrative embodiment is propylene glycol; however, the heat transfer fluid 100 may be any thermally conductive fluid, for example water, brines, coolants, oils, glycols, and refrigerants. The reservoir 48 can be constructed of stainless steel or other materials known in the art and serves one or more functions, including providing an even distribution of cooling or heating from the evaporator 70 or other thermal element(s), operating as a thermal sink, and thermally coupling the evaporator 70 or other thermal element with each of the members 94 and the plates 30-40. Although the illustrative embodiment shown in FIG. 2 shows the evaporator 70 in direct contact with the thermally conductive member 94, a space may be defined between the evaporator 70 and a member 94, in which case the heat transfer fluid 100 provides the thermal coupling between the elements. The reservoir 48 extends nearly the full length of the bar 20, as shown in FIG. 1, in order to contain substantially the full length of the evaporator 70 or other thermal element(s) that is thermally coupled with the members 94 and the plates 30-40.

In the illustrative embodiment, the reservoir 48 is enclosed within a housing 102 that also encloses a connecting conduit 78 of the thermal exchanger system 26, for example, the conduit 78 may be an elongate tube that carries expanded refrigerant back to the compressor 72. The conduit 78 may be surrounded by an insulation layer 112 to prevent thermal transfer of heat from the refrigerant to the reservoir 48. The housing 102 may be constructed of, for example, stainless steel and may be soldered, brazed, welded, or otherwise coupled with the a reservoir 48.

One or both of the reservoir 48 and the housing 102 may be soldered, brazed, welded or otherwise coupled with the thermally conductive member 94 in order to support and position of the member 94 and the thermal plate 30 relative to the bar top 44. As illustrated in FIG. 2, a mounting bracket 104 can be attached to the lower surface 50 of the bar top 44 with associated hardware 106. Positioning hardware 108 interfaces with the bracket 104 and can be used to vertically position and retain the housing relative to the bar top 44; therefore vertically positioning the upper surface 42 of the thermal plate 30 relative to the upper surface 46 of the bar top 44. An insulation layer 92 may also be located between one or both of the housing 102 and the reservoir 48 and the lower surface 50 of the bar top 44. Additionally, the open space 110 within the housing can be filled with thermal insulation, for example expandable foam.

The temperature sensor 84 is located in close thermal proximity to at least one of the thermal plates 30-40. For example, the sensor 84 may be located within the reservoir 48 as shown in FIG. 2, or may be coupled directly with or integral to the thermal plate 30 or the thermally conductive member 94.

In order to provide both hot and cold plates 30-40 or plates 30-40 that may be selected between a hot and cold setting, each thermal plate 30-40 may have associated with it more than one thermal element 70 and/or the apparatus 22 may include more than one heat exchanger system 26, more than one reservoir 48, or a heat exchanger system 26 that is selectable between a cooling or heating function. For example, for an embodiment that is selectable between a cooling and heating function, a second thermal element is located adjacent the thermally conductive member 94 and the reservoir 48. The second thermal element may be, for example, a conduit functioning as a condenser and associated with a second thermal exchanger system, thereby providing a selectable source for heating the thermal plates 30-40.

While the invention has been illustrated and described in detail in the foregoing drawings and description, the same is to be considered as illustrative and not restrictive in character, it being understood that only illustrative embodiments thereof have been show and described and that all changes and modifications that are within the scope of the following claims are desired to be protected.

The invention claimed is:

1. A thermal surface apparatus, comprising:

a furniture top having an upper surface and a lower surface;

a first opening defined in the upper surface of the furniture top;

a first thermally conductive plate having a single continuous upper surface and a lower surface, the first plate positioned in the first opening such that the upper surface of the first plate substantially fills the first opening and such that the upper surface of the furniture top and the upper surface of the first plate are substantially coplanar;

a thermal exchanger thermally coupled with the first plate;

a thermally conductive member thermally coupled between the first plate and the thermal exchanger; and a reservoir, the reservoir containing a heat transfer fluid, the heat transfer fluid thermally coupled with the member and the thermal exchanger;

the thermal exchanger comprising:

a vapor-compression system; and an evaporator tube in contact with at least one of the heat transfer fluid and the member.

2. The thermal surface apparatus of claim 1, further comprising:

a second opening defined in the upper surface of the furniture top; and a second thermally conductive plate having an upper surface and a lower surface, the second plate positioned in the second opening such that the upper surface of the furniture top and the upper surface of the second plate are substantially coplanar; and wherein the thermal exchanger is thermally coupled with the second plate.

3. The thermal surface apparatus of claim 1, wherein the heat transfer fluid includes propylene glycol.

4. The thermal surface apparatus of claim 1, further comprising:

a temperature sensor adapted to provide a signal relating to a temperature of at least one of the first plate, the member, and the heat transfer fluid; and a controller associated with the thermal exchanger and adapted to receive the signal and to operate the thermal exchanger to control the temperature to a desired temperature.

5. The thermal surface apparatus of claim 1, wherein the thermal exchanger is configured to cool the first plate.

6. The thermal surface apparatus of claim 1, wherein the thermal exchanger is configured to heat the first plate.

7. The thermal surface apparatus of claim 1, wherein the first plate is sized to support a single refreshment container.

8. The thermal surface apparatus of claim 1, wherein:

the furniture top includes an accessible edge; and the horizontal dimensions of the first plate define a depth and a width, the depth being sized to support a single refreshment container, and the width being sized to support multiple refreshment containers.

9. The thermal surface apparatus of claim 1, wherein the furniture top includes a surface for at least one of storing, serving, and consuming refreshments.

10. A thermal surface apparatus comprising:

a furniture top having an upper surface and a lower surface;

a first opening defined in the upper surface of the furniture top, the first opening includes a recess;

a first thermally conductive plate having a single continuous upper surface and a lower surface, the first plate positioned in the first opening such that the upper surface of the first plate substantially fills the first opening and such that the upper surface of the furniture top and the upper surface of the first plate are substantially coplanar;

a thermal exchanger thermally coupled with the first plate;

a thermally conductive member thermally coupled between the first plate and the thermal exchanger;

a reservoir, the reservoir containing a heat transfer fluid, the heat transfer fluid thermally coupled with the member and the thermal exchanger; and a bore is defined from the recess through to the lower surface of the furniture top, and at least a portion of the member is positioned within the bore and the reservoir is positioned adjacent the lower surface of the furniture top.

11. The thermal surface apparatus of claim 10, further comprising:

a second opening defined in the upper surface of the furniture top; and a second thermally conductive plate having an upper surface and a lower surface, the second plate positioned in the second opening such that the upper surface of the furniture top and the upper surface of the second plate are substantially coplanar; and wherein the thermal exchanger is thermally coupled with the second plate.

12. The thermal surface apparatus of claim 10, wherein the heat transfer fluid includes propylene glycol.

13. The thermal surface apparatus of claim 10, further comprising:

a temperature sensor adapted to provide a signal relating to a temperature of at least one of the first plate, the member, and the heat transfer fluid; and a controller associated with the thermal exchanger and adapted to receive the signal and to operate the thermal exchanger to control the temperature to a desired temperature.

14. The thermal surface apparatus of claim 10, wherein the thermal exchanger is configured to cool the first plate.

15. The thermal surface apparatus of claim 10, wherein the thermal exchanger is configured to heat the first plate.

16. The thermal surface apparatus of claim 10, wherein the first plate is sized to support a single refreshment container.

17. The thermal surface apparatus of claim 10, wherein:

the furniture top includes an accessible edge; and the horizontal dimensions of the first plate define a depth and a width, the depth being sized to support a single refreshment container, and the width being sized to support multiple refreshment containers.

18. The thermal surface apparatus of claim 10, wherein the furniture top includes a surface for at least one of storing, serving, and consuming refreshments.

* * * * *